US005782096A

United States Patent [19]

Bartlett et al.

[11] Patent Number: 5,782,096

[45] Date of Patent: Jul. 21, 1998

[54] CRYOPUMP WITH IMPROVED SHIELDING

[75] Inventors: Allen J. Bartlett, Mendon; John J. Casello, Norton, both of Mass.

[73] Assignee: Helix Technology Corporation, Mansfield, Mass.

[21] Appl. No.: 795,981

[22] Filed: Feb. 5, 1997

[51] Int. Cl.[6] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 3,579,998 | 5/1971 | Thibault et al. | 62/55.5 |
| 3,721,101 | 3/1973 | Sheppard et al. | 62/55.5 X |
| 4,277,951 | 7/1981 | Longsworth | 62/55.5 |
| 4,555,907 | 12/1985 | Bartlett | 62/55.5 |
| 4,599,869 | 7/1986 | Ozin et al. | 62/55.5 |
| 5,056,319 | 10/1991 | Strasser | 62/55.5 |
| 5,062,271 | 11/1991 | Okumura et al. | 62/55.5 |
| 5,156,007 | 10/1992 | Bartlett et al. | 62/55.5 |
| 5,231,840 | 8/1993 | Yagi et al. | 62/55.5 |
| 5,261,244 | 11/1993 | Lessard et al. | 62/55.5 |
| 5,537,833 | 7/1996 | Matte et al. | 62/55.5 |
| 5,542,257 | 8/1996 | Mattern-Klosson et al. | 62/55.5 |

OTHER PUBLICATIONS

Longsworth, R.C., et al., "Cryopump vacuum recovery after pumping Ar and $H_2$," *J. Vac. Sci. Technol.*, 9(5):2766–2770, (1991).

*Primary Examiner*—Christopher Kilner

*Attorney, Agent, or Firm*—Hamilton, Brook, Smith & Reynolds, P.C.

[57] ABSTRACT

A cryopump includes a two-stage refrigerator, a primary pumping surface, and a radiation shield. The radiation shield is in thermal contact with the first stage of the refrigerator. The primary pumping surface is surrounded by the radiation shield and is in thermal contact, through a direct conductive link, with the second stage of the refrigerator. The refrigerator, however, is external to the radiation shield.

15 Claims, 7 Drawing Sheets

CRYOPUMP WITH IMPROVED SHIELDING

BACKGROUND OF THE INVENTION

Cryogenic vacuum pumps (cryopumps) remove gases from a surrounding atmosphere by freezing gas molecules onto low-temperature cryopanels. Currently available cryopumps generally follow a common design concept. A low-temperature array, usually operating in the range of 4 to 25 K, is the primary pumping surface. This surface is surrounded by a radiation shield, usually operated in the temperature range of 60 to 130 K. The radiation shield generally includes a housing which is closed, except where a frontal array is positioned at an open end, or front opening, of the housing.

In operation, the cryopump causes high-boiling-point gases such as water vapor to condense on the frontal array. Lower-boiling-point gases pass through that array and into the volume within the radiation shield where they condense on the low-temperature array. A surface coated with an adsorbent such as charcoal or a molecular sieve operating at or below the temperature of the colder array may also be provided in this volume to remove gases with especially low boiling points, such as hydrogen. With the gases thus condensed and/or adsorbed onto the pumping surfaces, a vacuum is created in the work chamber.

Where the cryopump is cooled by a closed-cycle cryocooler, the cooler is typically a cryogenic refrigerator having a cold finger which extends through the rear or side of the radiation shield. To achieve cooling, the cryogenic refrigerator processes a cyclic flow of compressed gas, such as helium, through a refrigeration cylinder within the refrigerator. A source of compressed gas, i.e., a compressor, is typically connected to a first end of the cylinder through an inlet valve. An exhaust valve in an exhaust line leads from the first end of the cylinder to the low-pressure side of the compressor. Initially, a displacer including a regenerative heat exchange matrix (regenerator) is at a second end of the cylinder. The exhaust valve is closed, and the inlet valve is open causing the cylinder to fill with compressed gas. With the inlet valve still open, the displacer moves toward the first end to force compressed gas through the regenerator to the second end, the gas being cooled as it passes through the regenerator. When the inlet valve is closed and the exhaust valve opened, the gas expands into the low-pressure exhaust line and cools further. The resulting temperature gradient across the cylinder wall at the second end causes heat to flow from the load into the gas within the cylinder. Then, with the exhaust valve opened and the inlet valve closed, the displacer returns to the second end. The gas is thereby displaced back through the regenerator which returns heat to the cold gas, and the cycle is completed.

To produce the low temperatures required for cryopump uses, the incoming gas must be cooled before expansion. The regenerator extracts heat from the incoming gas, stores it, and then releases it to the exhaust stream. A regenerator is a reversing-flow heat exchanger through which the helium passes alternately in either direction. It is comprised of a material of high surface area, high specific heat, and low thermal conductivity. Thus, it will accept heat from the helium if the helium's temperature is higher and release this heat to the helium if the helium's temperature is lower.

To achieve temperatures sufficiently cold to condense low-boiling-point gases, such as nitrogen, oxygen and argon, a second stage of refrigeration is typically added as shown by FIG. 1. In the device of FIG. 1, helium enters the refrigerator through valve A and exits through valve B. The first-stage displacer 207 includes a first regenerator 211, and the second-stage displacer 209 includes a second regenerator 213. Heat is extracted from a first-stage thermal load 203 and a second-stage thermal load 205. In a typical cryopump, the first-stage load includes a radiation shield and a frontal array, and the second-stage load is a low-temperature array which serves as the primary pumping surface, as described below.

Embodiments of the radiation shield and the primary pumping surface, as well as other cryopump components to follow, are illustrated in FIGS. 2A and 2B. FIG. 2A illustrates a conventional design of a cryopump wherein the refrigerator and the cryopanels are coaxial. Therein, a first stage 29 of the refrigerator extends through the vacuum vessel 11 to the base of the radiation shield 36. The radiation shield 36, serving as the first-stage load, is connected to the coldest end of the first stage 29. The radiation shield 36 surrounds a primary pumping surface 34 so as to protect it from radiant heat. A frontal array 38 is attached to a front opening 16 of the radiation shield 36 and is cooled by the first-stage 29 by way of conduction through the radiation shield 36 or, as disclosed in U.S. Pat. No. 4,356,701, through thermal struts.

The second stage 32, which is the colder of the two stages, extends from the interior surface of the radiation shield 36 through the primary pumping volume to where it is thermally mounted to the primary pumping surface 34. In this design, one can see that the core of the baffle array 34 is hollowed to accommodate the second stage 32 and pumping volume is lost. The coldest end of the second stage 32 is at the tip of the cold finger. The primary pumping surface 34 is connected to a second-stage heat sink 30 (see FIG. 2B) at this coldest end. The cryopanel serving as the primary pumping surface 34 may be an array of metal baffles, as shown in FIGS. 2A and 2B, or it may be a simple metal plate or cup connected to the second-stage heat sink 30. Additionally, the second-stage cryopanel also supports the low temperature adsorbent.

The second-stage cylinder 32 typically exhibits a gradually decreasing temperature gradient of approximately 77 to 15 K from the end at which it interfaces with the first stage to its coldest, distal end where it is thermally coupled to the primary pumping surface 34. The vapor pressures of all gases rise with temperature; and, as the vapor pressures rise with temperature, the rate at which gases condense and the duration for which they remain condensed drops. Consequently, gases condense more readily and with greater security upon the cylinder 32 at its colder end.

In operation, a cryopump may be exposed to a high pressure for some period and then be called upon to reduce the pressure significantly. At high pressure, a gas, such as argon, may condense upon the second stage at any point that has been sufficiently cooled. When a thermal load is applied to the first stage, such as by opening a valve in the system, the temperature of the first stage increases, thereby altering the temperature distribution down the length of the second stage. As temperature increases, vapor pressure rises; and any of the gas which had condensed upon the second stage, particularly the gas which had previously condensed in the present wake of the retreating cold temperature zone, may be liberated once again as vapor.

This rapid process of sublimation may produce a sharp increase in work chamber pressure. Moreover, the existence of the incremental temperature gradient along the second stage may result in a lengthy "hang up" of pressure, wherein gas molecules undergo a repeated cycle of condensation and sublimation while only gradually migrating to the colder primary pumping surface 34. Further, even when the thermal load on the second stage 32 is constant, the displacer within the refrigerator cylinder reciprocates. This reciprocation produces a continuous fluctuation in temperature along its path; and as the temperature fluctuates, so does the vapor pressure to consequentially produce a high-frequency fluctuation of the pressure in the work chamber. To mitigate the effects of condensation on the second stage cylinder, a shield 5 (illustrated in FIG. 2B) has been added to surround the second stage 32.

The embodiment illustrated in FIG. 2B is disclosed in U.S. Pat. No. 5,156,007. This design is recognized as the conventional-design "flat" cryopump, and it incorporates a right angle alignment of the cryocooler and the vacuum vessel thereby providing a more vertically-compact structure. Therein, the design of the cryopanel must be modified to accommodate the intrusion of the second stage through the pump volume to a position where it is thermally coupled with the cryopanel. As shown in FIG. 2B, the second stage 32 projects into a condensation chamber defined by the radiation shield 36. Therein, the second stage 32 penetrates the side of the baffle array 34 to a centrally-located position at which the second stage 32 is thermally coupled with, and thereby cools, the baffle array 34. Further, the second-stage shield 5, which surrounds the second stage 32 and prevents unwanted condensation from forming thereon, creates an even greater intrusion and disruption of the baffle array design.

DISCLOSURE OF THE INVENTION

Where the second stage penetrates the primary pumping volume, as shown in FIGS. 2A and 2B, it disrupts the design continuity of the primary pumping surface and reduces the available cryopump surface area. Further, the nonsymmetrical configuration of the primary pumping surface shown in FIG. 2B has been found to produce nonuniform and unbalanced condensation deposits during pump operation. These deposits limit the pumping capacity of the cryopump.

The present invention relates to a cryopump providing an improved configuration of refrigeration and shielding elements. The improved cryopump includes a refrigerator having a first stage and a second, colder stage. The first stage is in thermal contact with a radiation shield, whereby the temperature of the two can be equilibrated. The second stage is in direct thermal contact with a primary pumping surface on which low-boiling point gases condense. Importantly, both the first and second stages are external to the volume surrounded by the radiation shield.

In a preferred embodiment, a second-stage shield, which is also external to the radiation shield, surrounds the second stage and is cooled by one of the two refrigerator stages. The primary pumping surface may be an array of baffles supported by and thermally coupled with at least one strut. The strut provides the predominant mode of heat transfer, by thermal conduction, between the primary pumping surface and the second stage. The strut may be a separate member upon which the primary pumping surface is mounted, or it may simply be an extension of the material that forms the primary pumping surface extending down and mounted to the second stage. The cryopump may also include an external electronics module positioned in the crook of the "L" shape formed by the radiation shield and the refrigerator.

A cryopump condensation apparatus includes a radiation shield, which defines a condensation chamber; a second-stage shield, which is in thermal contact with the radiation shield yet positioned outside the condensation chamber; and a primary pumping surface within the condensation chamber. A cryopump shield includes the radiation shield and the second-stage shield described above. The second-stage shield preferably includes a first flange for mounting it to the first stage of a refrigerator. The shield further includes a second flange oriented along a plane perpendicular to that of the first flange for mounting the second-stage shield to a radiation shield. In accordance with one aspect of the invention, thermal coupling is also provided between the second-stage shield and both the radiation shield and the first stage.

Placement of the second stage outside of the radiation shield allows the use of a symmetrical and uninterrupted array of baffles which produces more uniform frost distribution and greater pumping capacity.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily drawn to scale, emphasis instead being placed upon illustrating the principles of the invention.

DETAILED DESCRIPTION OF PREFERRED EMBODIMENT

Figure 1:
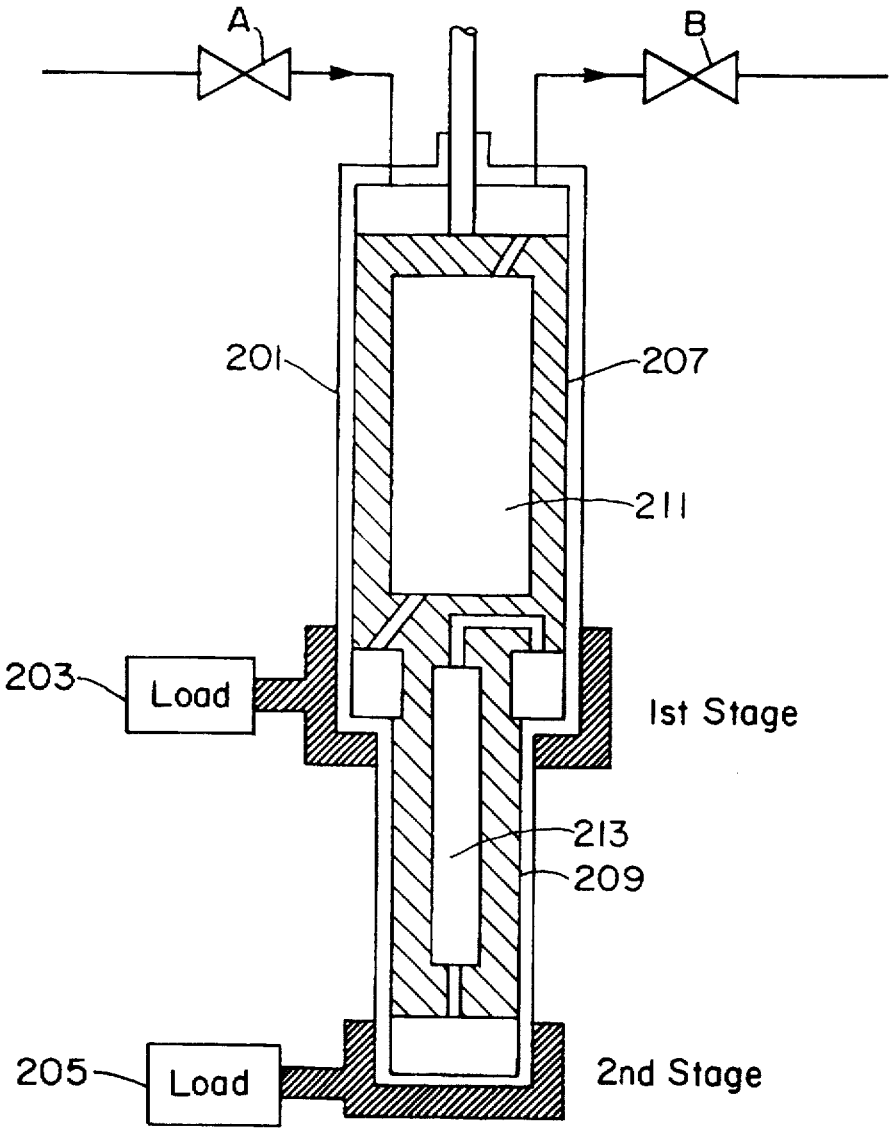
FIG. 1 PRIOR ART
FIG. 1 is a schematic illustration of a conventional closed-cycle cryogenic refrigerator of a cryopump.
Figure 2A:
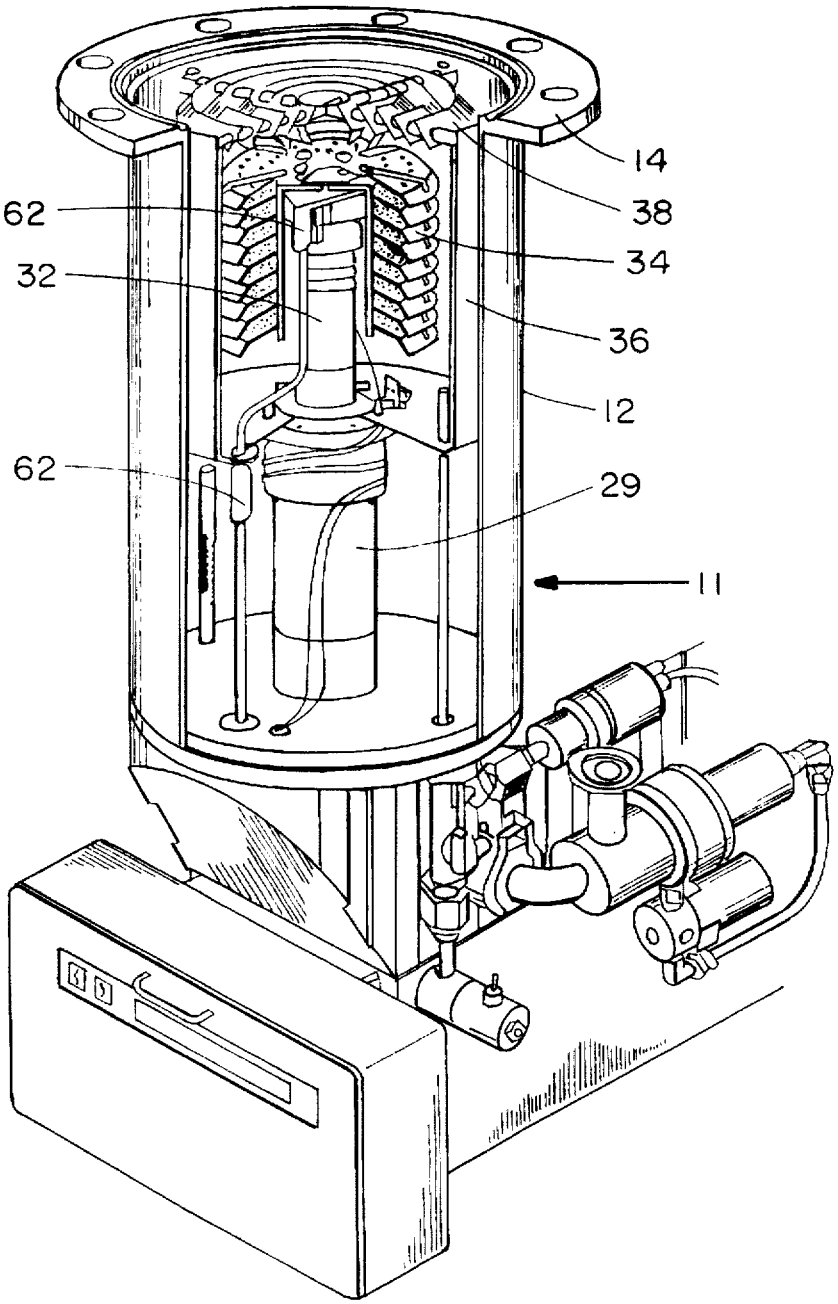
FIG. 2A PRIOR ART
FIG. 2A is a perspective view, partially in cross-section, of an embodiment of the prior art.
Figure 2B:
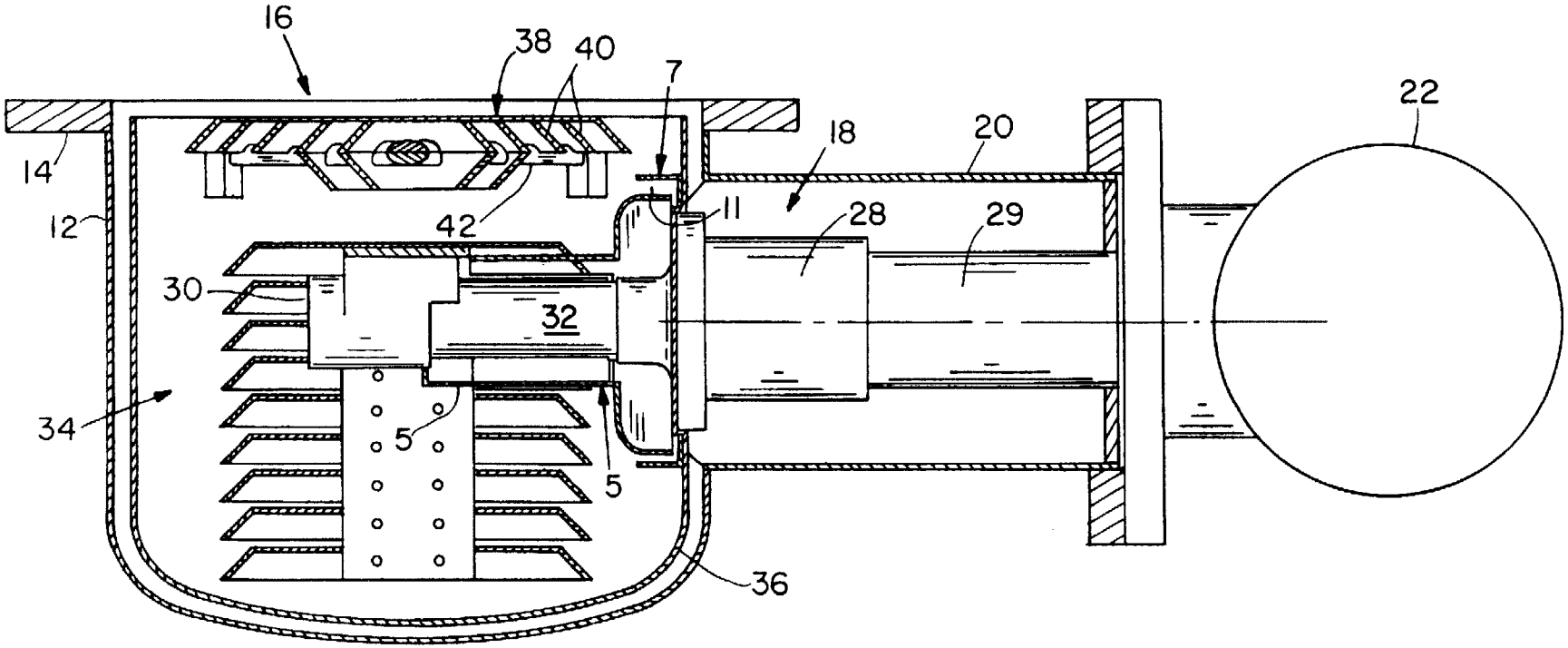
FIG. 2B PRIOR ART
FIG. 2B is a cross-sectional side view of another embodiment of the prior art.
Figure 3:
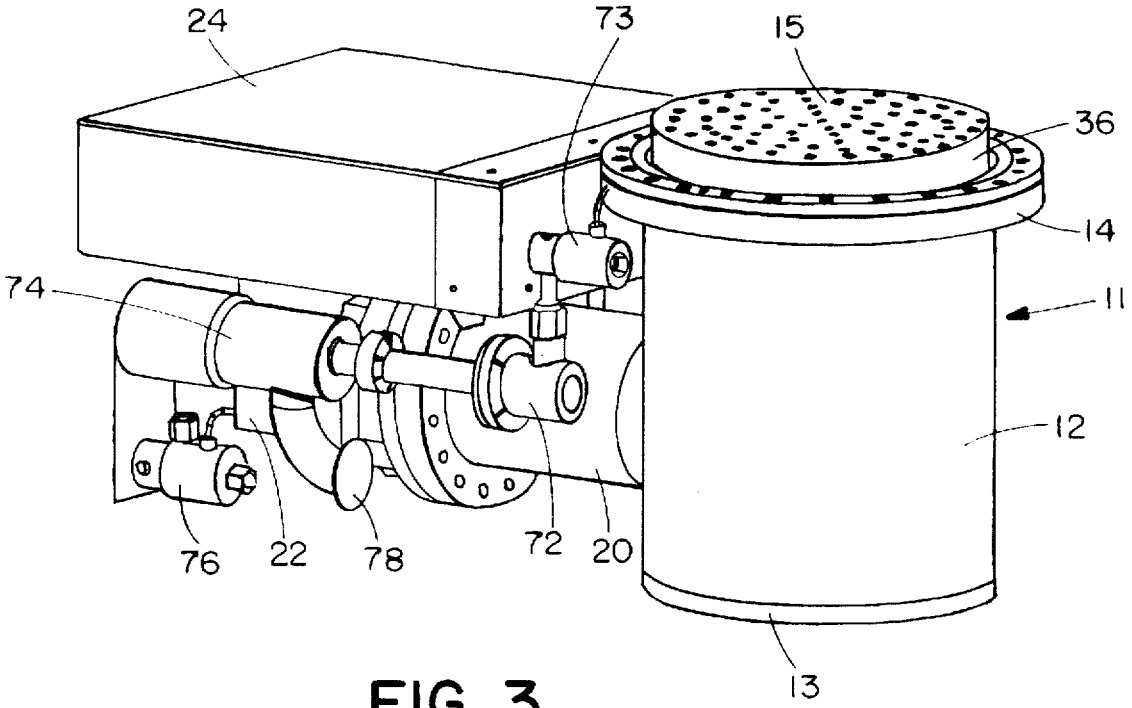
FIG. 3 is a perspective view of a cryopump embodying the present invention.

The exterior of a cryopump with a preferred configuration is shown in FIG. 3. A vacuum vessel 11, including an outer cylinder 12, a base 13 and a first-stage shell 20, surrounds a vacuum chamber where most gases, excluding water, are primarily condensed or adsorbed. The vacuum vessel 11 can be mounted to a work chamber, not shown, at an external flange 14. At the end of the vacuum vessel 11 opposite the base 13, an orifice plate 15 is attached to and cooled by the radiation shield 36. The orifice plate 15 extends past the flange 14 of the vacuum vessel 11 into the work chamber.

Projecting from the outer cylinder 12 along an axis orthogonal to the axis along which the outer cylinder is oriented is a first-stage shell 20. The refrigerator, itself, is inserted within this shell 20 such that it projects into the outer cylinder 12 where it cools the pumping surfaces housed therein. The first-stage shell 20 is mounted to the motor housing 22, wherein the motor that drives the refrigerator is located. An electronics housing 24, where the programmed controls of the cryopump are located, is positioned adjacent to the outer cylinder 12 and adjacent to the first-stage shell 20.

Mechanical atmospheric controls are also illustrated. Though hidden from view in FIG. 3, a vapor-release conduit 70 (see FIG. 4) is mounted to the first-stage shell 20 and provides fluid communication with the vacuum chamber. Extending away from the first-stage shell 20, the vapor-release conduit 70 branches into a pair of outlets leading to a safety relief valve purge housing 72 and a rough vacuum valve 74, respectively. The safety relief valve purge housing 72 encloses a safety relief valve for venting high pressures from the chamber. Extending from the housing 72 and coupled to the safety relief valve is a purge solenoid 73 for actuating the purge to the relief valve. Mounted to the end of the opposite branch of the vapor-release conduit 70, a rough vacuum valve within housing 74 provides communication with a rough pump for mechanically evacuating gas from the chamber. The valve 74 is controlled by an actuating solenoid valve 76 and leads to the rough pump through a rough vacuum connection 78.

Though hidden from view in FIG. 3, a regeneration purge solenoid valve 80 (see FIG. 5) is mounted to the outer cylinder 12. Through openings in both the outer cylinder 12 and the radiation shield 36, the regeneration purge solenoid valve 80 applies a nitrogen purge during regeneration. When regeneration is performed, sufficient thermal energy is supplied to the baffle array 34 to sublimate the gases that have condensed thereupon and thereby clean the pumping surfaces. Also hidden on the far side of the first-stage shield 20, a temperature sensor electronic feed through 82 for measuring the temperature within the chamber is evident in FIG. 5. Finally, on this same side of the first-stage shield 20, a helium-supply fitting 84 for feeding helium to the first and second stages as well as a helium-supply return 86 for returning expanded helium from the cryocooler to the compressor are shown.

Figure 4:
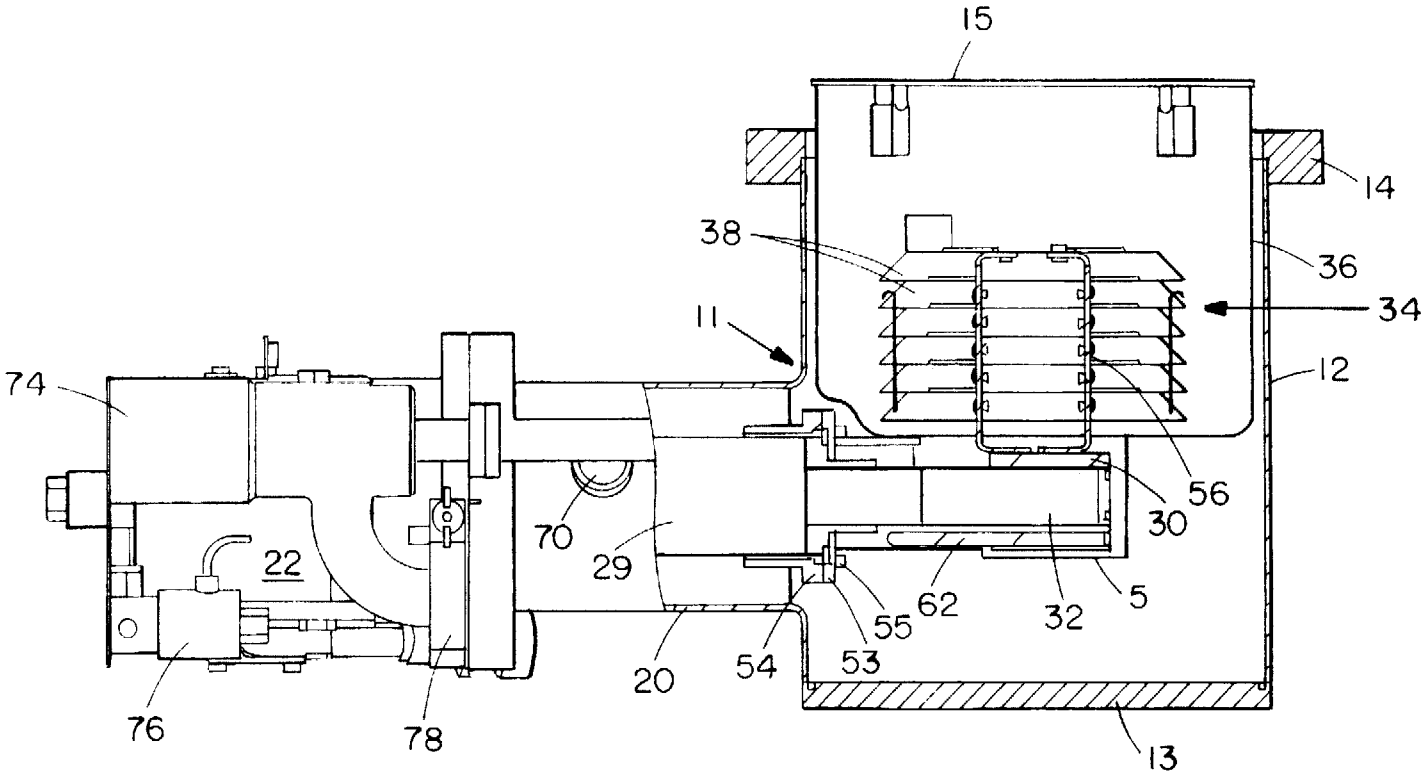
FIG. 4 is a cross-sectional side view of a cryopump embodying the present invention.
Figure 5:
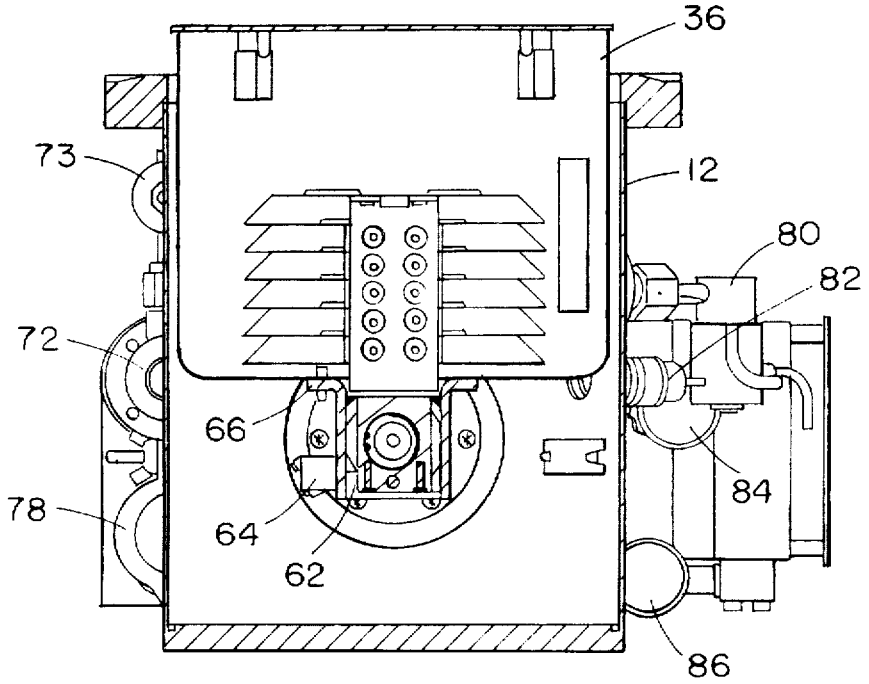
FIG. 5 is a cross-sectional view of a cryopump embodying the present invention from a perspective wherein the cryopump is rotated along the horizontal plane 90° clockwise from the perspective producing FIG. 4.

FIGS. 4 and 5 provide cross-sectional illustrations of the cryopump shown in FIG. 3. Positioned within and concentric to the vacuum vessel is a radiation shield 36. The radiation shield 36, along with the orifice plate 15 attached at its frontal opening, defines a condensation chamber within which a primary pumping surface 34 (here, in the form of a baffle array) is mounted. The baffle array 34 is formed of semicircular, frustoconically-rimmed discs 37. During operation of the cryopump, low-boiling-point gases condense upon these discs to create a vacuum in the surrounding atmosphere.

The orifice plate 15 is not only mounted upon the radiation shield 36, but also in thermal contact with the radiation shield 36. Accordingly, gases with higher condensing temperatures, such as water vapor, from the work chamber will condense upon the orifice plate 15 when the refrigerator is operating. Meanwhile, the flow of low-condensing-temperature gases from the work chamber to the condensation chamber will be restricted by the orifice plate 15 which acts as a partial barrier to gas flow. The flow of such gases is restricted to maintain a moderate pressure of low-condensing-temperature gas in the work chamber by slowing the rate at which low-condensing-temperature gases enter the condensation chamber.

Use of an orifice plate 15 is advantageous in conventional systems where cryopumps are used to create a proper atmosphere for sputtering. In these systems, inert gases such as argon are injected into the work chamber during sputtering to raise the work chamber pressure and to provide an inert gas environment. However, operation of the cryopump is needed to remove other gases. The necessary pressure differential created by the moderating function of the orifice plate 15 allows such an environment to be maintained without the inert gas rapidly overloading the baffle array 34. In other applications the orifice plate may be replaced with other frontal arrays such as a chevron array.

The baffle array 34 is supported by thermal struts 56 which extend from a second-stage heat sink 30. The struts 56 thereby provide not only physical support but also thermal coupling between the second-stage heat sink 30 and the baffle array 34. As the refrigerator performs the refrigeration process, the second stage 32 extracts heat through its second-stage heat sink 30 from the baffle array 34 to cool the baffle array 34. During operation, the baffle array 20 is preferably cooled by the second stage 32 to a temperature below 20 K to condense low-condensing-temperature gases.

The second stage cylinder 32 is surrounded with a second-stage shield 5 which protects the second stage 32 from ambient gases which would otherwise condense upon the second stage 32. Penetrating through the second-stage shield 5, a heater 62 provides heat to the second stage 32 to regulate the second stage temperature and, at scheduled intervals, to drive the cryopump through the regeneration process. The heater 62 runs alongside the first stage 29 and enters the volume enclosed by the second-stage shield 5 through a projected housing 64. Once received within the second-stage shield 5, the heater 62 bears toward the distal end of the second-stage and enters into view in FIG. 4, from which point the heater 62 tracks a path alongside the second stage 32. The heater 62 is in close thermal contact with the heat sink 30 but does not contact the second-stage cylinder 32.

Figure 6:
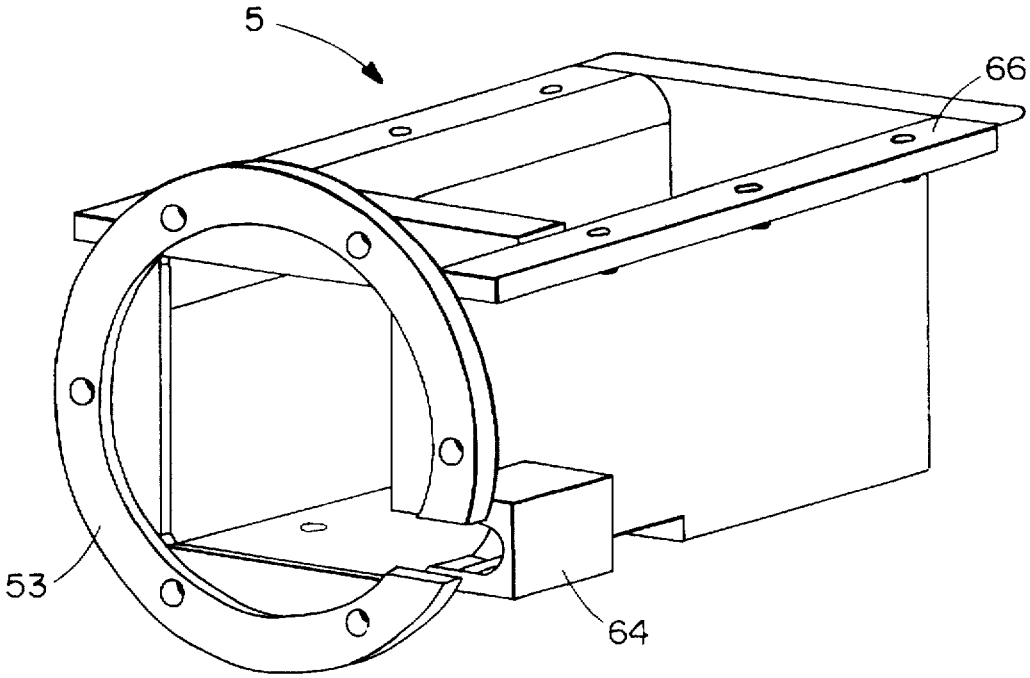
FIG. 6 is a perspective view of the second-stage shield surrounding the second stage.

The second-stage shield 5, shown alone in detail in FIG. 6, includes a pair of flanges 53 and 66, oriented perpendicular to one another, by which the second-stage shield 5 is mounted to the first-stage heat sink 54 and the radiation shield 36, respectively. The first flange 53 can be mounted to, and also be thermally coupled with, the first-stage heat sink 54 with bolts 55, and an indium seal placed between the first flange 53 and the first-stage heat sink 54. The second flange 66 can likewise be mounted to, and thermally coupled with, the radiation shield 36 with bolts and an indium seal.

When these components are mounted together, as described, heat can be conducted from the radiation shield 36 through the second-stage shield 5 to the first-stage heat sink 54. Heat then flows from the first-stage heat sink 54 through the cold end of the first stage 29 to the cooled working gas of the refrigerator. Accordingly, the radiation shield 36 can be cooled to a temperature approaching that of the cold end of the first stage 29. Preferably, the radiation shield is maintained at a temperature of less than about 120 K during operation. As shown in FIGS. 4 and 5, both the second stage 32 and the second-stage shield 5 are positioned external to the volume enclosed by the radiation shield 36.

As illustrated in detail in FIG. 6, the first flange 53, through which the second-stage shield is mounted to the first-stage heat sink, is essentially ring-shaped. However, a gap in the ring exists where the heater is fed into a projected housing 64 of the second-stage shield 5. The projected housing reaches out from shield 5 to accept the heater which feeds to a position where the heater can supply heat to the second stage 32 of the refrigerator.

To assemble the system, the second stage 32 is inserted into the second-stage shield 5 through the orifice defined by the first flange 53, and that assembly is then inserted through the first stage shell 20. The motor housing 22 is bolted to the shell 20. The radiation shield is then bolted from the inside to the second flange 66.

The baffle array, mounted to struts, can then be loaded into the condensation chamber through the front opening before the frontal array is mounted thereon. The struts, inserted through an opening in the base of the radiation shield and the open space defined by the second flange 66, are then mounted to and thermally coupled with the second stage. Finally the top plate of the second stage array is mounted to the struts, and the orifice plate is mounted to the radiation shield.

While this invention has been particularly shown and described with references to preferred embodiments thereof, it will be understood by those skilled in the art that various changes in form and details may be made therein without departing from the scope of the invention as defined by the appended claims.

We claim:

1. A cryopump comprising:

a refrigerator including a first stage and a second stage;

a primary pumping surface in thermal contact, through a conductive link, with the second stage of the refrigerator;

a radiation shield surrounding the primary pumping surface and in thermal contact with the first stage of the refrigerator, the first and second stages of the refrigerator being external to the radiation shield; and a vessel defining a chamber encompassing both the radiation shield and the second stage of the refrigerator.

2. The cryopump of claim 1 further comprising a second-stage shield within the vessel surrounding the second stage and cooled by one of the first and second stage.

3. The cryopump of claim 2 wherein the thermal contact between the primary pumping surface and the second stage is provided by at least one strut physically supporting the primary pumping surface.

4. The cryopump of claim 3 wherein the primary pumping surface includes an array of baffle sections.

5. The cryopump of claim 4 wherein each baffle section is fixed to at least one strut.

6. The cryopump of claim 5 wherein the baffle sections are semicircular discs with frustoconical rims.

7. The cryopump of claim 5 wherein the radiation shield is mounted to the second-stage shield.

8. A cryopump comprising:

a radiation shield including a sidewall having an open end and a closed end, the closed end closed by a base plate, a condensation chamber being defined by the volume within the sidewall;

an array of baffles within the condensation chamber;

a refrigerator having a first stage in thermal contact with the radiation shield and a second stage, the first and second stages located outside of the condensation chamber;

at least one strut physically supporting the array of baffles, in thermal contact with the array of baffles and mounted to the second stage of the refrigerator, the predominant mode of heat transfer between the array of baffles and the second stage of the refrigerator being thermal conduction through the strut; and a vessel defining a chamber encompassing both the radiation shield and the second stage of the refrigerator.

9. A cryopump comprising:

a refrigerator extending along a first axis;

a radiation shield having a closed end mounted to the refrigerator, wherein the radiation shield extends away from the closed end along a second axis generally perpendicular to the first axis; and an electronics module electronically coupled with the refrigerator and positioned in a crook of the juncture of the radiation shield and the refrigerator.

10. A cryopump condensation apparatus for use in a cryopump, including a refrigerator having a first stage and a second stage, comprising:

a radiation shield defining a condensation chamber;

a second-stage shield for thermal contact with the first stage of the refrigerator and for surrounding the second stage of the refrigerator, wherein the second-stage shield includes a first flange for coupling to the first stage of the refrigerator and a second flange coupled to the radiation shield, wherein the second flange is oriented along an axis approximately perpendicular to that of the first flange, and wherein the second-stage shield is outside the condensation chamber; and a primary pumping surface for thermal contact with the second stage of the refrigerator, wherein the primary pumping surface is within the condensation chamber.

11. A cryopump shield for use in a cryopump including a primary pumping surface and a refrigerator having a first stage and a second stage, the second stage in thermal contact with the primary pumping surface, comprising:

a radiation shield defining a condensation chamber; and a second-stage shield for thermal contact with the first stage of the refrigerator and for surrounding the second stage of the refrigerator, wherein the second-stage shield includes a first flange for coupling to the first stage of the cryogenic refrigerator and a second flange coupled to the radiation shield, wherein the second flange is oriented along an axis approximately perpendicular to that of the first flange, and wherein the second-stage shield is outside the condensation chamber.

12. A second-stage shield for use in a cryopump which includes (a) a refrigerator having first and second stages extending along a first axis, (b) a primary pumping surface in thermal contact with the second stage, (c) a radiation shield surrounding the primary pumping surface, extending along a second axis generally perpendicular to the first axis, and in thermal contact with the first stage and (d) a second-stage shield surrounding the second stage and thermally coupled to the first stage, the second-stage shield comprising:

a first flange for coupling the second-stage shield to the first stage; and a second flange oriented along an axis generally perpendicular to that of the first flange for coupling the second-stage shield to the radiation shield.

13. The second-stage shield of claim 12, further comprising a first thermal coupling for providing thermal contact between the second-stage shield and the first stage and a second thermal coupling for providing thermal contact between the second-stage shield and the radiation shield.

14. The cryopump of claim 1 wherein at least one thermally-conductive strut is mounted to both the primary pumping surface and the second stage of the refrigerator.

15. A cryopump shield for use in a cryopump including a primary pumping surface and a refrigerator having first and second stages, the second stage in thermal contact with the primary pumping surface, comprising:

a radiation shield defining a condensation chamber; and a second-stage shield for thermal contact with the first stage of the refrigerator and for surrounding the second stage, wherein the second-stage shield is directly mounted to the radiation shield, and wherein the second-stage shield is outside the condensation chamber.

* * * * *